US007143807B2

(12) United States Patent
Newcomb

(10) Patent No.: US 7,143,807 B2
(45) Date of Patent: Dec. 5, 2006

(54) MOLD DESIGN FOR IMPROVED BORE LINER DIMENSIONAL ACCURACY

(75) Inventor: Thomas P. Newcomb, Defiance, OH (US)

(73) Assignee: General Motors Corporation, Detroit, MI (US)

( * ) Notice: Subject to any disclaimer, the term of this patent is extended or adjusted under 35 U.S.C. 154(b) by 191 days.

(21) Appl. No.: 10/862,072

(22) Filed: Jun. 4, 2004

(65) Prior Publication Data

US 2005/0269054 A1 Dec. 8, 2005

(51) Int. Cl.
*B22D 33/04* (2006.01)

(52) U.S. Cl. ..... 164/340; 164/370; 164/332; 164/334

(58) Field of Classification Search ..... 164/340, 164/137, 9, 11, 30, 370, 332, 334
See application file for complete search history.

(56) References Cited

U.S. PATENT DOCUMENTS

| | | | | |
|---|---|---|---|---|
| 5,730,200 | A | 3/1998 | Landua | |
| 5,771,955 | A * | 6/1998 | Helgesen et al. | 164/9 |
| 6,615,901 | B1 * | 9/2003 | Kaminski et al. | 164/137 |
| 6,942,007 | B1 * | 9/2005 | Meyer | 164/137 |

* cited by examiner

*Primary Examiner*—Kevin Kerns
*Assistant Examiner*—I. H. Lin
(74) *Attorney, Agent, or Firm*—Charles H. Ellerbrock

(57) ABSTRACT

A mold design is disclosed for sand casting of engine cylinder blocks, such as engine cylinder V-blocks, with cast-in-place cylinder bore liners, wherein a dimensional accuracy in the positioning of cast-in-place bore liners is maximized.

18 Claims, 2 Drawing Sheets

MOLD DESIGN FOR IMPROVED BORE LINER DIMENSIONAL ACCURACY

FIELD OF THE INVENTION

The invention relates to a mold design and more particularly to the mold design for sand casting of engine cylinder blocks, such as engine cylinder V-blocks, with cast-in-place cylinder bore liners.

BACKGROUND OF THE INVENTION

In the manufacture of cast iron engine V-blocks, a so-called integral barrel crankcase core has been used and consists of a plurality of barrels formed integrally on a crankcase region of the core. The barrels form the cylinder bores in the cast iron engine block without the need for bore liners.

In the sand casting process of an aluminum internal combustion engine cylinder V-block, an expendable mold package is assembled from a plurality of resin-bonded sand cores (also known as mold segments) that define the internal and external surfaces of the engine V-block. Typically, each of the sand cores is formed by blowing resin-coated foundry sand into a core box and curing it therein. Cast-in-place bore liners are often used in such castings.

Traditionally, in the manufacture of an aluminum engine V-block with cast-in-place bore liners, the mold assembly method involves positioning a base core on a suitable surface and building up or stacking separate mold elements to shape such casting features as the sides, ends, valley, water jacket, cam openings, and crankcase. The bore liners are positioned on barrel cores such that the liners become embedded in the casting after the metal is poured into the mold. Additional cores may be present as well depending on the engine design. Various designs for the barrel cores are used in the industry. These include individual barrel cores, "V" pairs of barrel cores, barrel-slab cores, and integral barrel crankcase cores. The barrel-slab and integral barrel crankcase designs are often preferred because they provide more accurate positioning of the liners within the mold assembly.

The engine block casting must be machined in a manner to ensure, among other things, that the cylinder bores (formed from the bore liners positioned on the barrel features of the barrel cores) have uniform bore liner wall thickness, and other critical block features are accurately machined. This requires the liners to be accurately positioned relative to one another within the casting, and that the block is optimally positioned relative to the machining equipment.

The position of the bore liners relative to one another within a casting is determined in part by the dimensional accuracy and assembly clearances of the mold components (cores) used to support the bore liners during the filling of the mold. Another important consideration is the ease and consistency with which the liners are brought into the desired final position during the mold assembly process. The final positioning of the liners during mold assembly is often facilitated by the use of angled seats in the mold that engage with mating chamfers on the inner diameter at each end of the liners. The force required to achieve this final engagement of the tapered seat into the liner chamfer can be substantial, especially in V-type casting molds, resulting in damage to the sand seats and/or failure to fully engage said seat into the liner chamfer.

It would be desirable to produce a core for sand casting of engine cylinder blocks wherein a dimensional accuracy in the positioning of cast-in-place bore liners is maximized.

SUMMARY OF THE INVENTION

Consistent and consonant with the present invention, a barrel core design for sand casting of engine cylinder blocks wherein a dimensional accuracy in the positioning of cast-in-place bore liners is maximized, has surprisingly been discovered.

In one embodiment, the barrel core for sand casting of engine cylinder blocks comprises at least one cylinder barrel having a first end and a second end, an outer surface of the at least one cylinder barrel formed to include a draft angle from the first end to the second end thereof, the outer surface adapted to receive a cast-in-place bore liner and including at least one protuberance formed thereon to maximize a dimensional accuracy in positioning of the bore liner.

In another embodiment, the core comprises a crankcase core region; a cam shaft passage forming region disposed on the crankcase core region; and a plurality of spaced apart cylinder barrels arranged to form at least one row and extending outwardly from a base end on the crankcase core region to terminate at a free end, each of the cylinder barrels including at least one protuberance formed on an outer surface thereof to maximize a dimensional accuracy in positioning of a bore liner in a desired position on each of the cylinder barrels.

In another embodiment, the core comprises an integral barrel crankcase core adapted to be assembled in a mold package, the integral barrel crankcase core including a crankcase core region and a cam shaft passage forming region; a plurality of spaced apart cylinder barrels arranged to form at least one row and extending outwardly from a base end on the crankcase core region to terminate at a free end, each of the cylinder barrels including at least one protuberance formed on an outer surface thereof; and a hollow, cast-in-place bore liner disposed on each of the cylinder barrels, the at least one protuberance causing a dimensional accuracy in positioning of the bore liner on each of the cylinder barrels to be maximized.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
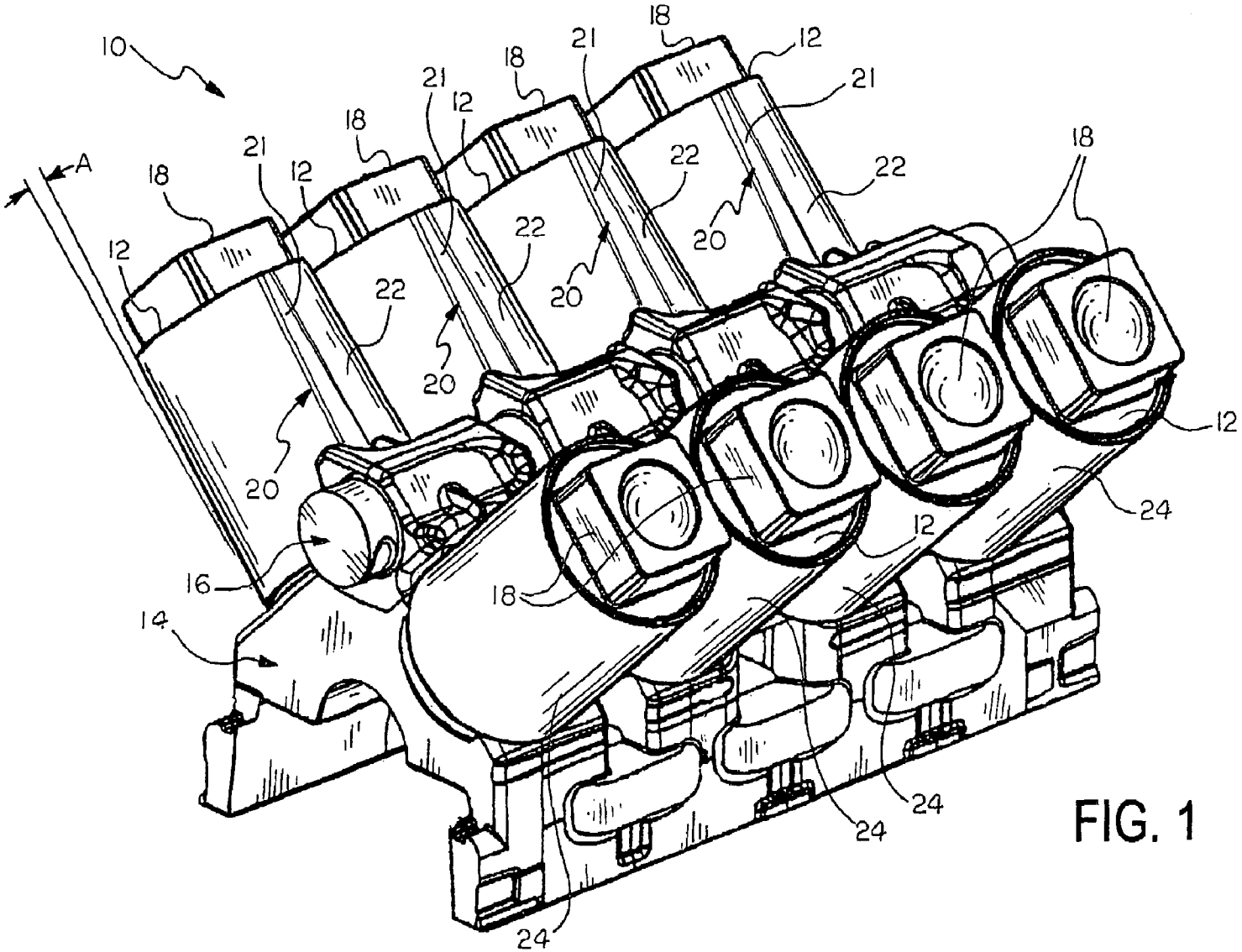
FIG. 1 is a perspective view of an integral barrel crankcase core according to an embodiment of the invention.

Referring now to FIG. 1, an integral barrel crankcase core 10 according to an embodiment of the invention is shown. For purposes of illustration, and not limitation, a core for an eight-cylinder V-type engine is shown. It is understood that more or fewer cylinders can be used and that other engine cylinder configurations can be used without departing from the scope and spirit of the invention. It is also understood that the features of the invention described herein could be used with a barrel-slab core or other barrel core type. In the embodiment shown, a resin bonded sand core is used.

The integral barrel crankcase core 10 includes a plurality of cylinder barrels 12 extending outwardly therefrom and terminating at a free end. In the V-type engine, the cylinder barrels 12 are disposed in two rows of cylinder barrels 12 with planes through an axis or centerline of the cylinder barrels 12 of each row. The planes of each row of the cylinder barrels 12 intersect at an angle to one another in a crankcase portion of the engine block casting (not shown). Common configurations include V6 engine blocks with 54°, 60°, 90°, and 120° of included angle between the two rows of the cylinder barrels 12 and V8 engine blocks with a 90° angle between the two rows of the cylinder barrels 12, although other configurations can be used. The cylinder barrels 12 are disposed on a crankcase core region or section 14. In the embodiment shown, a cam shaft passage forming region 16 is integrally formed with the crankcase core region 14 on the integral barrel crankcase core 10.

Each of the cylinder barrels 12 includes a core print 18 formed thereon. The core prints 18 are shown as flat-sided polygons in shape for purposes of illustration only, as other shapes and configurations of core prints 18 can be used. Additionally, although male core prints 18 are shown, it is understood that female core prints can be used. The core prints 18 are adapted to mate with corresponding core prints formed on a jacket slab assembly (not shown).

Figure 3:
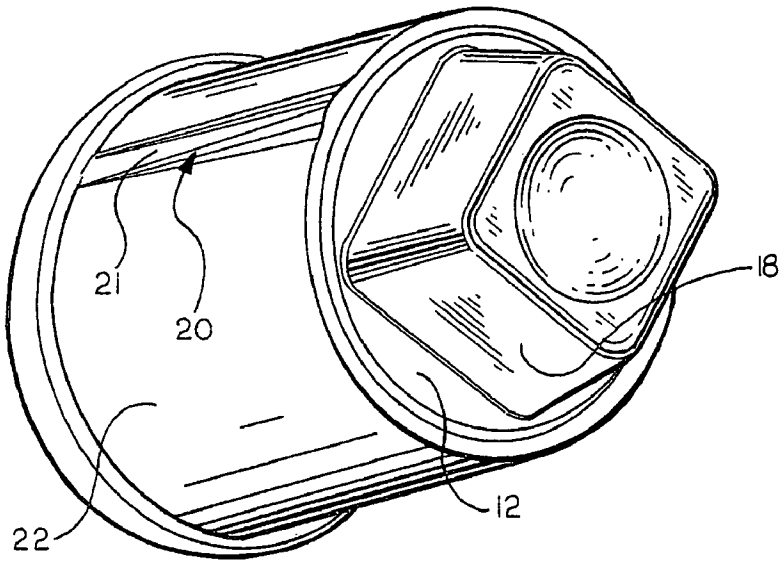
FIG. 3 is a perspective view of one of the barrels of the integral barrel crankcase core of FIG. 1 and showing the protuberant portion of the barrel.

An axially extending protuberance or raised portion 20 is formed on an upwardly facing outer surface 22 of the cylinder barrels 12, as shown in FIGS. 1 and 3. The protuberance 20 is visible only on the left side row of cylinder barrels 12. The protuberance 20 has a narrow surface portion 21 extending from a base end of the cylinder barrels 12 to the free end of the cylinder barrels 12. The surface portion 21 has a radius of curvature about substantially the same axis as the cylinder barrels 12. A width of the flat surface portion of the protuberance 20 decreases as the protuberance 20 extends outwardly from the base to the free end of the cylinder barrels 12. The outer surface 22 has a draft angle or outside diametral taper represented by A in FIG. 1. While the outer surface 22 has a draft angle typically less than 2° or more preferably about 0.5°, the protuberance 20 has a draft angle of about zero degrees on the surface portion 21. It is understood that other configurations for the protuberances 20 can be used such as a plurality of radially spaced protuberances, a protuberance extending only a portion of the length of the cylinder barrel 12, a plurality of axially spaced protuberances, or a protuberance which includes a draft angle and the draft angle is less than the draft angle of the outer surface 22, for example, without departing from the scope and spirit of the invention.

On the right side row of cylinder barrels 12 in FIG. 1, bore liners 24 are shown disposed thereon. The bore liners 24 form the cylinder wall for each cylinder of the engine block after the casting thereof. In the embodiment shown and described, the engine block is cast from aluminum. It is understood that other materials can be used for the bore lines 24 and the engine block as desired. The bore liners 24 are typically formed of cast iron and have a substantially circular cross section and have a hollow interior of uniform diameter. The bore liners 24 can also have an axial taper on an inner surface thereof as disclosed in U.S. Pat. No. 6,615,901.

Figure 2:
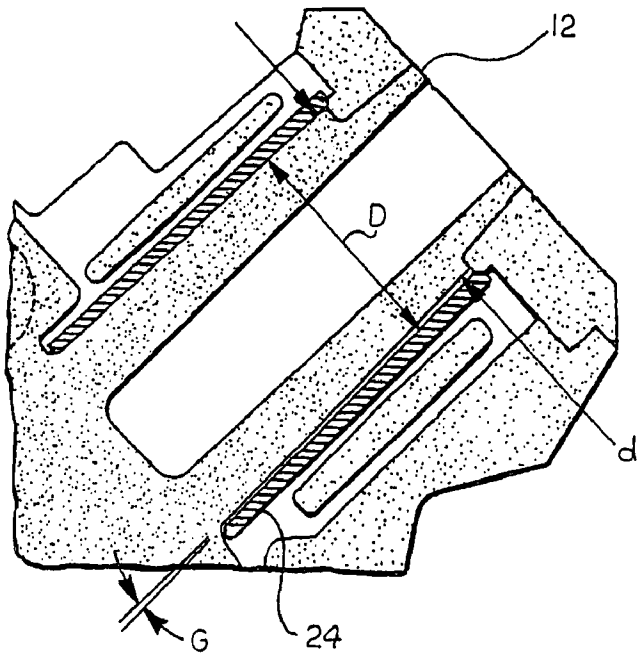
FIG. 2 is an enlarged sectional view of one of the barrels of the integral barrel crankcase core illustrated in FIG. 1 and showing a cylinder bore liner on the barrel.

FIG. 2 shows a sectional view of one of the cylinder barrels 12 of the integral barrel crankcase core 10 illustrated in FIG. 1 and showing a cylinder bore liner 24 on the cylinder barrel 12. The inner diameter D of the bore liners 24 is typically formed to be slightly larger than an outer diameter d of the cylinder barrels 12 to militate against damage or scoring of the sand forming the cylinder barrels 12 during installation of the bore liners 24. As a result of this difference and the draft angle included on the cylinder barrel 12, a gap will result between the tapered cylinder barrels 12 and the bore liners 24, as signified by the arrows G in FIG. 2. The weight of the bore liners 24 causes the gap to occur at the bottom (lower) radial portion of the non-vertical cylinder barrels 12. The formation of the protuberance 20 at the upper portion of the cylinder barrels 12 militates against formation of the gap G. The protuberance 20 thus facilitates a proper alignment of the bore liners 24, as is further discussed below.

A mold package (not shown) is typically assembled from numerous types of resin-bonded sand cores as described in commonly owned U.S. Pat. No. 6,615,901, hereby incorporated herein by reference. The integral barrel crankcase core 10 is typically one of the cores used to assemble the mold package. The proper initial positioning of the bore liners 24 prior to insertion of a tapered seat of a slab core, for example, facilitates proper engagement of the seat into the bore liner 24 which in turn facilitates proper final positioning of the bore liners 24. If misaligned or positioned or located improperly, damage or other undesirable effects can occur during the mold package assembly and during or after the casting operation.

The bore liners 24 can be installed on the cylinder barrels 12 by manual or automated means. The cylinder barrels 12 are positioned inside of the hollow interior of the bore liners 24. It is desirable that the curvature of the surface portion 21 has a curvature substantially equal to the curvature of the inner surface of the bore liner 24. As the cylinder barrel 12 is caused to move into the interior of the bore liner 24, the protuberance 20 guides the interior wall of the bore liner 24. The protuberance 20 essentially lifts the bore liner 24 to make the bore liner 24 more nearly concentric with the cylinder barrel 12. The amount of additional lifting or final positioning required during final assembly of the mold package is thus minimized. The gap between outer surface 22 of the cylinder barrel 12 and the inner wall of the bore liner 24 is more uniformly distributed. This in turn causes the dimensional accuracy of the final positioning of the bore liner 24 to be maximized.

Resin-bonded sand cores can be formed using conventional core-making processes such as a phenolic urethane cold box process, for example, where a mixture of foundry sand and resin binder is blown into a core box and the binder cured with a catalyst gas. The foundry sand can comprise silica, zircon, fused silica, combinations of these, and others, as desired. A catalyzed binder can comprise Isocure binder available from Ashland Chemical Company, for example. After forming the integral barrel crankcase core 10, it is removed from the core box. Having a draft angle formed on the majority of the outer wall of each of the cylinder barrels 12 facilitates removal of the integral barrel crankcase core 10 from the core box after forming and curing.

As discussed above the outer surface 22 has a draft angle A typically less than 1° or more preferably about 0.5° and the protuberance 20 has a draft angle of about zero degrees. The use of "zero" draft contradicts generally accepted tooling design paradigms. However, it has been learned that zero draft can be implemented if the zero-drafted contact surface area between the core box and the protuberance 20 is small in comparison to the drafted contact surface area between the core box and the bulk of the cylinder barrel 12. It is further necessary that core features that include minimally drafted regions are sufficiently robust (in terms of the sand cross-section through which tensile stress is borne during core extraction) that tensile failure of the core is avoided. The increase in the width of the flat portion of the protuberance 20 as the protuberance 20 extends inwardly from the free end of the cylinder barrel 12 to the base (due to the application of draft to the sides of the protuberance) minimizes abrasive wear of the tooling as the sides of the protuberance travel out of the tooling cavity. The result is minimized frictional forces between the core box and the cylinder barrels 12. This can also be accomplished by providing a small draft angle (less that the draft angle of the outer surface 22 of the cylinder barrels 12), a shortening of the axial length of the protuberance 20, providing a plurality of protuberances 20 having a smaller total contact area with the core box, and the like, as desired.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A mold for sand casting of engine cylinders comprising:

at least one cylinder barrel having a first end and a second end, an outer surface of said at least one cylinder barrel formed to include a draft angle from the first end to the second end thereof, the outer surface adapted to receive a cast-in-place bore liner and including at least one protuberance formed thereon to maximize a dimensional accuracy in positioning of the bore liner, wherein the at least one protuberance has a draft angle of about zero degrees.

2. The mold according to claim 1, wherein said at least one cylinder barrel has a longitudinal axis and the at least one protuberance formed on said at least one cylinder barrel extends in an axial direction from the first end to the second end.

3. The mold according to claim 2, wherein the at least one protuberance includes a surface portion formed thereon.

4. The mold according to claim 3, wherein a width of the surface portion of the at least one protuberance decreases as the at least one protuberance extends outwardly from the first end to the second end of said at least one cylinder barrel.

5. The mold according to claim 3, wherein the draft angle of the outer surface of said at least one cylinder barrel is less than two degrees and the surface portion of the at least one protuberance has a draft angle of about zero degrees.

6. The mold according to claim 3, wherein the draft angle of the outer surface of said at least one cylinder barrel is about 0.5 degrees and the surface portion of the at least one protuberance has a draft angle of about zero degrees.

7. A mold for sand casting of engine cylinder blocks comprising:

a crankcase core adapted to be assembled in a mold package; and a plurality of spaced apart cylinder barrels arranged to form at least one row and extending outwardly from a base end disposed on said core to terminate at a free end, an outer surface of each of said cylinder barrels adapted to receive a bore liner and including at least one protuberance formed thereon to maximize a dimensional accuracy in positioning of the bore liner, wherein the at least one protuberance extends from the first end to the second end of each of said cylinder barrels.

8. The core according to claim 7, wherein each of said cylinder barrels has a longitudinal axis and the at least one protuberance formed on each of said cylinder barrels extends in an axial direction from the base end to the free end.

9. The core according to claim 8, wherein the at least one protuberance formed on each of said cylinder barrels includes a surface portion formed thereon.

10. The core according to claim 9, wherein a width of the surface portion decreases as the at least one protuberance extends outwardly from the base to the free end of each of said cylinder barrels.

11. The core according to claim 9, wherein the outer surface of said cylinder bores has a draft angle less than two degrees and the surface portion has a draft angle of less than the draft angle of the outer surface of said cylinder bores.

12. The core according to claim 9, wherein the outer surface of said cylinder bores has a draft angle of about 0.5 degrees and the surface portion has a draft angle of about zero degrees.

13. A mold for sand casting of engine cylinder blocks comprising:

an integral barrel crankcase core adapted to be assembled in a mold package, said integral barrel crankcase core including a crankcase core region;

a plurality of spaced apart cylinder barrels arranged to form at least one row and extending outwardly from a base end disposed on said crankcase core region to terminate at a free end, an outer surface of each of said cylinder barrels including at least one protuberance formed thereon, wherein at least a portion of the at least one protuberance is formed adjacent the free end of each of said cylinder barrels; and a hollow cast-in-place bore liner disposed on each of said cylinder barrels, the at least one protuberance causing a dimensional accuracy in positioning of said bore liner on each of said cylinder barrels to be maximized.

14. The core according to claim 13, wherein each of said cylinder barrels has a longitudinal axis and the at least one protuberance formed on each of said cylinder barrels extends in an axial direction from the base end to the free end.

15. The core according to claim 14, wherein the at least one protuberance formed on each of said cylinder barrels is formed on an upper portion of the outer surface thereof.

16. The core according to claim 14, wherein the at least one protuberance formed on each of said cylinder barrels includes a surface portion formed thereon.

17. The core according to claim 16, wherein the outer surface of said cylinder bores has a draft angle of less than two degrees and the surface portion of the at least one protuberance has a draft angle less than the draft angle of the outer surface of said cylinder bores.

18. The core according to claim 17, wherein the outer surface of said cylinder bores has a draft angle of about 0.5 degrees and the surface portion of the at least one protuberance has a draft angle of about zero degrees.

* * * * *